US005346793A

United States Patent [19]

Bertrand et al.

[11] Patent Number: 5,346,793

[45] Date of Patent: Sep. 13, 1994

[54] TONER COMPOSITIONS WITH ALUMINUM CHARGE ENHANCING ADDITIVES

[75] Inventors: Jacques C. Bertrand, Ontatio; Denise R. Bayley, Fairport; Thomas R. Pickering, Webster; Roger N. Ciccarelli, Rochester, all of N.Y.

[73] Assignee: Xerox Corporation, Stamford, Conn.

[21] Appl. No.: 948,554

[22] Filed: Sep. 23, 1992

[51] Int. Cl.[5] ..... G03G 9/097

[52] U.S. Cl. ..... 430/110; 430/107; 430/109

[58] Field of Search ..... 430/110, 109, 107

[56] References Cited

U.S. PATENT DOCUMENTS

| | | | |
|---|---|---|---|
| 4,206,064 | 6/1980 | Kiuchi et al. | 430/106 |
| 4,298,672 | 11/1981 | Lu | 430/108 |
| 4,411,974 | 10/1983 | Lu et al. | 430/106 |
| 4,845,003 | 7/1989 | Kiriu et al. | 430/110 |
| 4,935,326 | 6/1990 | Creatura et al. | 430/108 |
| 4,937,166 | 6/1990 | Creatura et al. | 430/108 |
| 5,223,368 | 6/1993 | Ciccarelli | 430/110 |
| 5,232,809 | 8/1993 | Anzai et al. | 430/110 |

FOREIGN PATENT DOCUMENTS

| | | | |
|---|---|---|---|
| 2-163061 | 7/1987 | Japan | 430/110 |
| 3-134672 | 6/1991 | Japan | 430/110 |

*Primary Examiner*—Marion E. McCamish
*Assistant Examiner*—Janis L. Dote
*Attorney, Agent, or Firm*—E. O. Palazzo

[57] ABSTRACT

A negatively charged toner composition comprised of resin particles, pigment particles, and an aluminum charge enhancing additive obtained from the reaction of an aluminum inorganic salt solution and an alkoxy substituted benzoic acid.

14 Claims, No Drawings

TONER COMPOSITIONS WITH ALUMINUM CHARGE ENHANCING ADDITIVES

BACKGROUND OF THE INVENTION

The present invention is generally directed to toner and developer compositions, and more specifically, the present invention is directed to developer and toner compositions containing charge enhancing additives, which impart or assist in imparting a negative charge to the toner particles and enable toners with rapid triboelectric charging characteristics. In embodiments, there are provided in accordance with the present invention toner compositions comprised of a polymer, or polymer resins, pigment particles or dye molecules, and certain metal salts, especially aluminum charge enhancing additives. In embodiments, the present invention is directed to toners with aluminum charge enhancing additives, which additives can be obtained from the reaction of aluminum inorganic salts with alkoxy, about, for example, 1 to 10 carbon atoms, substituted benzoic acids. The aforementioned charge additives, especially bis(3,5-dimethoxybenzoato)hydroxy aluminum, bis(3,4-diethoxybenzoato)hydroxy aluminum or bis(3,4,5-trimethoxybenzoato)hydroxy aluminum, in embodiments of the present invention enable, for example, toners with rapid and stable triboelectric charging characteristics. Also, the aforementioned toner compositions usually contain a colorant component comprised of, for example, carbon black, magnetites, or mixtures thereof, color pigments, dyes, cyan, magenta, yellow, blue, green, red, or brown pigments, or mixtures thereof thereby providing for the development and generation of black and/or colored images. The toner and developer compositions of the present invention can be selected for electrophotographic, especially xerographic, imaging and printing processes, including color processes.

Toners with negative charge additives are known, reference for example U.S. Pat. Nos. 4,411,974 and 4,206,064, the disclosures of which are totally incorporated herein by reference. The '974 patent discloses negatively charged toner compositions comprised of resins, pigment particles, and as a charge enhancing additive ortho-halophenyl carboxylic acids. Similarly, there are disclosed in the '064 patent toner compositions with chromium, cobalt, and nickel complexes of salicylic acid as negative charge enhancing additives. In U.S. Pat. No. 4,845,003, there are illustrated negatively charged toners with certain aluminum complex charge additives. More specifically, this patent discloses as charge additives aluminum salts comprised of two or three hydroxybenzoic acid ligands bonded to a central aluminum ion. A disadvantage of some of these charge additives is their thermal instability, that is they often break down during the thermal extrusion process of the toner manufacturing cycle. Another disadvantage is that some of these additives are colored which makes them unsuitable to be used in nonblack toners. A fast rate of triboelectric charging is particularly crucial for high speed xerographic machines since, for example, these machines consume toner rapidly, and fresh toner has to be constantly added. The added uncharged toners, therefore, must charge up to their equilibrium triboelectric charge level rapidly to ensure no interruption in the xerographic imaging or printing operation. Many of these and other disadvantages are eliminated, or substantially eliminated with toners containing the metal salt charge additives of the present invention. Also, the toners of the present invention in embodiments maintain their rapid charging or admix necessary for high speed xerographic machines.

Developer compositions with charge enhancing additives, which impart a positive charge to the toner particles, are also well known. Thus, for example, there is described in U.S. Pat. No. 3,893,935 the use of quaternary ammonium salts as charge control agents for electrostatic toner compositions; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111; similar teachings are presented in U.S. Pat. No. 4,291,112 wherein A is an anion including, for example, sulfate, sulfonate, nitrate, borate, chlorate, and the halogens; U.S. Pat. No. 4,338,390, the disclosure of which is totally incorporated herein by reference, which illustrates developer compositions containing as charge enhancing additives organic sulfate and sulfonates, which additives can impart a positive charge to the toner composition; and U.S. Pat. No. 4,298,672, the disclosure of which is totally incorporated herein by reference, which illustrates positively charged toner compositions with resins and pigment particles, and as charge enhancing additives alkyl pyridinium compounds.

Illustrated in copending patent application U.S. Ser. No. 894,688, which is U.S. Pat. No. 5,275,900, issued Jan. 4, 1994, are toner compositions comprised of polymer resins, colorants comprised of color pigment particles or dye molecules, and certain metal complex charge additives derived from the reaction of a mixture of a hydroxybenzoic acid and a base with a metal ion in the presence of an excess of a hydroxyphenol. More specifically, disclosed in the aforementioned copending application are toner compositions comprised of polymer resins, color pigment, or dye, and a negative charge enhancing additive of the following formula

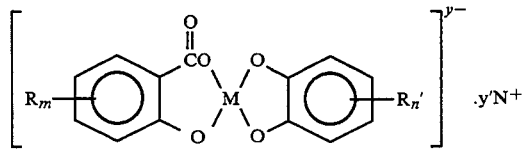

where M is a metal; N+ is a cation: R and R' are alkyl, alkoxy, aryloxy, halogen, carbonyl, amino, nitro, or mixtures thereof; m and n are the number of R substituents ranging from 0 to 3; y− is the magnitude of the negative charge of the anion; and y' represents the number of cations.

Although many charge enhancing additives are known, there continues to be a need for charge enhancing additives which when incorporated in toners, provide toners with many of the advantages illustrated herein. There is also a need for negative charge enhancing additives which are useful for incorporation into black and colored toner compositions which can be utilized for developing positive electrostatic latent images. Moreover, there is a need for colored toner compositions containing charge enhancing additives which do not interfere with the color quality of the colorants present in the toners. Another need relates to the provision of toner compositions with certain charge enhancing additives, which toners in embodiments thereof possess substantially stable triboelectric charge levels, and display acceptable rates of triboelectric charging characteristics. Furthermore, there is also a need for toner compositions with certain charge enhancing additives which possess excellent dispersibility characteristics in toner resins, and can, therefore, form stable dispersions in the toner compositions. There is also a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. 4,265,990, the disclosure of which is totally incorporated herein by reference. Also, there is a need for negative toner compositions which have desirable triboelectric charge levels of, for example, from between about −10 to about −40 microcoulombs per gram, and preferably from about −15 to about −25 microcoulombs per gram, and triboelectric charging rates of less about 120 seconds, and preferably less than 60 seconds as measured by standard charge spectrograph methods when the toners are frictionally charged against suitable carrier particles via conventional roll-milling techniques. The concentrations of the charge additives that can be incorporated into the toner compositions generally range from about 0.05 weight percent to about 10 weight percent, depending on whether the charge additive is utilized as a surface additive or as a dispersion in the bulk of the toner. The effective concentrations of toner in the developer, that is toner and carrier particles, are, for example, from about 0.5 to about 10 weight percent, and preferably from about 1 to about 3 weight percent.

SUMMARY OF THE INVENTION

It is an object of the present invention to provide toner and dry developer compositions with negative charge enhancing additives.

In another object of the present invention there are provided negatively charged toner compositions useful for the development of electrostatic latent images including color images.

A further object of the present invention is to provide a simple and cost effective process for the preparation of aluminum charge enhancing additives.

Also, in another object of the present invention there are provided toners with rapid admix charging characteristics, which toners contain as charge additives the aluminum salts of alkoxy substituted benzoic acids.

These and other objects of the present invention may be accomplished in embodiments thereof by providing toner compositions comprised of a polymer resin or resins, a colorant or colorants comprised of color pigment particles or dye molecules, and certain metal salt charge additives. More specifically, the present invention in embodiments is directed to toner compositions comprised of resin particles, pigment particles, and an aluminum metal negative charge enhancing additive of the formula

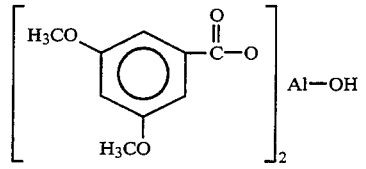

or

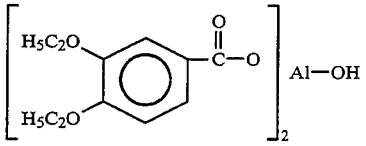

or

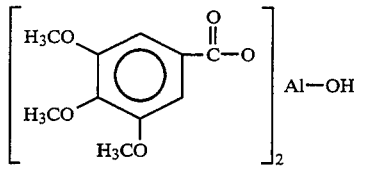

Examples of charge additives include bis(3,5-dimethoxybenzoato)hydroxy aluminum, aluminum, bis(3,4,5-trimethoxybenzoato)hydroxy aluminum, or mixtures thereof in embodiments.

The aforementioned charge additives can be incorporated into the toner, may be present on the toner surface or may be present on toner surface additives such as colloidal silica or $TiO_2$ (titanium oxide/particles. Advantages of rapid triboelectric charging characteristics of generally less than 120 seconds, and preferably less than 60 seconds in embodiments as measured by the known standard charge spectrograph methods when the toners are frictionally charged against carrier particles by known conventional roll mixing methods, appropriate triboelectric charge levels, and the like can be achieved with many of the aforementioned toners of the present invention. In another embodiment of the present invention there are provided, subsequent to known micronization and classification, toner particles with a volume average diameter of from about 5 to about 20 microns.

The aluminum charge additives of the present invention can be prepared by the reaction of alkoxy, wherein alkoxy can be methoxy, ethoxy, propoxy, butoxy, pentoxy, heptoxy, octoxy, and the like, substituted benzoic acid, such as 3,5-dimethoxybenzoic acid, 3,4-diethoxybenzoic acid or 3,4,5-trimethoxybenzoic acid dissolved with a known base, like sodium hydroxide, with an aqueous aluminum inorganic salt solution such as aluminum sulfate or aluminum chloride. The ratio of the reactants is such that there are 2 molecules of acid for every aluminum atom. The reaction can be accomplished at temperatures ranging from room temperature to 95° C. The resulting precipitate is filtered and washed with clean water and dried. The product is identified by infrared analysis.

The toner compositions of the present invention can be prepared by a number of known methods such as admixing and heating polymer resins such as styrene butadiene copolymers, colorants such as color pigment particles or dye compounds, and the aforementioned metal salt charge enhancing additive, or mixtures of charge additives in a concentration, preferably ranging from about 0.5 percent to about 10 percent, in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with a volume average diameter of from about 5 to about 25 microns, and preferably from about 5 to about 12 microns, which diameters are determined by a Coulter Counter. Subsequently, the toner compositions can be classified utilizing, for example, a Donaldson Model B classifier for the purpose of removing unwanted fine toner particles.

Illustrative examples of suitable toner resins selected for the toner and developer compositions of the present invention include vinyl polymers such as styrene polymers, acrylonitrile polymers, vinyl ether polymers, acrylate and methacrylate polymers; styrene acrylylates; epoxy polymers; polyurethanes; polyamides and polyimides; polyesters; and the like. The polymer resins selected for the toner compositions of the present invention include homopolymers or copolymers of two or more monomers. Furthermore, the above mentioned polymer resins may also be crosslinked depending on the desired toner properties. Illustrative vinyl monomer units in the vinyl polymers include styrene, substituted styrenes such as methyl styrene, chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of the dicarboxylic acid units in the polyester resins suitable for use in the toner compositions of the present invention include phthalic acids, terephthalic acids, isophthalic acids, succinic acids, glutaric acids, adipic acids, pimelic acids, suberic acids, azelaic acids, sebacic acids, maleic acids, fumaric acids, dimethyl glutaric acids, bromoadipic acids, dichloroglutaric acids, and the like; while illustrative examples of the diol units in the polyester resins include ethanediols, propanediols, butanediols, pentanediols, pinacols, cyclopentanediols, hydrobenzoins, bis(hydroxyphenyl)alkanes, dihydroxybiphenyls, substituted dihydroxybiphenyls, and the like.

As a toner resin, there can be selected polyester resins derived from a dicarboxylic acid and a diphenol. These resins are illustrated in U.S. Pat. No. 3,590,000, the disclosure of which is totally incorporated herein by reference; and polyester resins obtained from the reaction of bisphenol A and propylene oxide, followed by the reaction of the resulting product with fumaric acid, and branched polyester resins resulting from the reaction of dimethylterephthalate with 1,3-butanediol, 1,2-propanediol, and pentanetriol. Further, low melting polyesters, especially those prepared by reactive extrusion, reference U.S. Ser. No. 814,641 and U.S. Ser. No. 814,782, which is U.S. Pat. 5,227,460, issued Jul. 13, 1993, the disclosures of which are totally incorporated herein by reference, can be selected as toner resins. Other specific toner resins include styrene-methacrylate copolymers, and styrene-butadiene copolymers; PLIOLITES ®; and suspension polymerized styrene-butadienes, reference U.S. Pat. No. 4,558,108, the disclosure of which is totally incorporated herein by reference. Also, waxes with a weight average molecular weight of from about 1,000 to about 7,000, such as polyethylene, polypropylene, and paraffin waxes, can be included in, or on the toner compositions as fuser roll release agents.

The polymer resin or resins are present in a sufficient, but effective amount, for example from about 30 to about 95 weight percent. Thus, when 1 percent by weight of the charge enhancing additive is present, and 10 percent by weight of colorant, such as carbon black or color pigment, is contained therein, about 89 percent by weight of resin is selected. Also, the charge enhancing additive of the present invention may be applied on the surface of the toner particles. When used on the surface, the charge enhancing additive of the present invention is present in an amount of from about 0.05 weight percent to about 5 weight percent, and preferably from about 0.1 weight percent to about 1.0 weight percent.

Numerous well known suitable color pigments or dyes can be selected as the colorant for the toner compositions including, for example, carbon black, like REGAL 330 ®, nigrosine dye, metal phthalocyanines, aniline blue, magnetite, or mixtures thereof. The colorant, which is preferably carbon black or other color pigments, should be present in a sufficient amount to render the toner composition with a sufficiently high color intensity. Generally, the colorants are present in amounts of from about 0.1 weight percent to about 20 weight percent, and preferably from about 1 to about 10 weight percent based on the total weight of the toner composition; however, lesser or greater amounts of colorant can be selected.

When the colorants are comprised of magnetites or a mixture of magnetites and color pigment particles, thereby enabling, for example, single component toners and toners for magnetic ink character recognition (MICR) applications in some instances, which magnetites are a mixture of iron oxides ($FeO.Fe_2O_3$) including those commercially available as MAPICO BLACK ®, they are present in the toner composition in an amount of from about 5 weight percent to about 70 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK ®, in an amount of, for example, from about 5 to about 70, and preferably from about 10 to about 50 weight percent can be selected for the black toner compositions of the present invention.

There can also be blended with the toner compositions of the present invention external additives including flow aid additives, which additives are usually present on the surface thereof. Examples of these additives include colloidal silicas such as AEROSIL ®, $TiO_2$, metal salts and metal salts of fatty acids inclusive of zinc stearate, aluminum oxides, cerium oxides, titanium oxides, and mixtures thereof, which additives are generally present in an amount of from about 0.1 percent by weight to about 5 percent by weight, and preferably in an amount of from about 0.5 percent by weight to about 2 percent by weight. Several of the aforementioned additives are illustrated in U.S. Pat. No. 3,590,000 and 3,800,588, the disclosures of which are totally incorporated herein by reference.

With further respect to the present invention, colloidal silicas, such as AEROSIL ®, can be surface treated with the metal charge additives of the present invention illustrated herein in an amount of from about 1 to about 50 weight percent and preferably 10 weight percent to about 25 weight percent followed by the addition thereof to the toners in an amount of from 0.1 to 10 and preferably 0.1 to 5 weight percent.

Also, there can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc. VISCOL 550-P TM, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Encompassed within the scope of the present invention are colored toner and developer compositions comprised of toner resins, optional carrier particles, the charge enhancing additives illustrated herein, and as colorants red, blue, green, brown, magenta, cyan and/or yellow dyes or color pigments, as well as mixtures thereof. More specifically, with regard to the generation of color images utilizing a developer composition with the aluminum charge enhancing additives of the present invention, illustrative examples of magenta materials that may be selected as colorants include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as colorants include copper phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In embodiments, these colorants are present in the toner composition in an amount of from about 1 percent by weight to about 15 percent by weight based on the total weight of the toner.

For the formulation of developer compositions, there are mixed with the toner particles carrier components, particularly those that are capable of triboelectrically assuming an opposite polarity to that of the toner composition. Accordingly, the carrier particles of the present invention are selected to be those that would render the toner particles negatively charged while acquiring a positive charge polarity themselves via frictional charging against the toner particles of the present invention. The opposite charge polarities of the carrier and toner particles of the developer composition thus ensure the toner particles to adhere to and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. No. 4,937,166 and 4,935,326, the disclosures of which are totally incorporated herein by reference, including for example KYNAR ® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000, and preferably from between about 60 and 200 microns in volume average diameter thereby permitting them, for example, to possess sufficient density and inertia to avoid adherence to the electrostatic images during the development process. The carrier component can be mixed with the toner composition in various suitable combinations, such as about 1 to 7 parts of toner to about 100 parts to about 200 parts by weight of carrier.

The toner composition of the present invention can be prepared by a number of known methods including extrusion melt blending the toner resins, colorants, and the metal charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be first prepared, followed by addition of the charge enhancing additives and other optional surface additives, or the charge enhancing additive-treated surface additives such as colloidal silicas. Further, other methods of preparation for the toner are as illustrated herein.

The toner and developer compositions of the present invention may be selected for use in electrostatographic imaging apparatuses containing therein conventional photoreceptors providing that they are capable of forming positive electrostatic latent images relative to the triboelectric charge polarity of the toners.

The toners of the present invention are usually jetted and classified subsequent to preparation to enable toner particles with a preferred volume average diameter of from about 5 to about 25 microns, and more preferably from about 5 to about 12 microns. The triboelectric charging rates for the toners of the present invention are preferably less than 120 seconds, and more specifically, less than 60 seconds in embodiments thereof as determined by the known charge spectrograph method as described hereinbefore. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

The following Examples are being supplied to further illustrate various embodiments of the present invention, it being noted that these Examples are intended to illustrate and not limit the scope of the present invention. Comparative Examples are also presented.

EXAMPLE I

Synthesis of Bis(3,5-Dimethoxybenzoato)Hydroxy Aluminum

To a first solution of 1.65 grams (0.041 mole) of NaOH in 75 milliliters of water were added 5 grams (0.027 mole) of 3,5-dimethoxybenzoic acid. The resulting mixture was heated to 60° C. to dissolve the acid. A second solution was prepared by dissolving 4.57 grams (0.0069 mole) of aluminum sulfate, $Al_2(SO_4)_3.18H_2O$, in 50 milliliters of water with heating to 60° C. The solution containing the sodium salt of the acid was added rapidly and dropwise into the aluminum sulfate salt solution with stirring. When the addition was completed, the reaction mixture was stirred an additional 5 to 10 minutes at 60° C. and then cooled to room temperature, about 25° C. The mixture was then filtered and the collected solid product was washed with water until the acidity of the used wash water was about 5.5. The product was dried for 16 hours in a vacuum oven at 120° F. to afford 4.67 grams (0.0131 mole, 83.8 percent of theory) of a white powder. When a sample of the product obtained was analyzed for water by Karl-Fischer titration after drying for an additional 12 hours at 100° C. in a vacuum, the sample contained 2.3 weight percent of water. The theoretical value calculated for a one mole of water with the product is 4.25 percent weight of water.

Infrared spectra of the above product indicated the presence of an aluminum carboxylate (Al—COO—) bond not present in the starting acid and a decrease of the acid peaks characteristic of the starting material, 3,5dimethoxybenzoic acid. There also appears a shoulder on the hydroxyl band (3,400 to 3,500 $cm^{-1}$ region) that could be attributed to an Al-OH band.

Elemental Analysis for $C_{18}H_{19}O_9Al$ Calculated: C, 53.2; H, 4.72; Al, 6.64. Found: C, 51.3; H, 5.01; Al, 5.31.

EXAMPLE II

Synthesis of Bis(3,4-Diethoxybenzoato)Hydroxy Aluminums

To a solution of 1.43 grams (0.036 mole) of NaOH in 100 milliliters of water were added 5 grams (0.024 mole) of 3,4-diethoxybenzoic acid. The resulting mixture was heated to 60° C. to dissolve the acid. A second solution was prepared by dissolving 3.96 grams (0.0059 mole) of aluminum sulfate, $Al_2(SO_4)_3.18H_2O$, in 50 milliliters of water with heating to 60° C. The former solution containing the sodium salt of the acid was added rapidly and dropwise into the latter aluminum sulfate salt solution with stirring. When the addition was completed, the reaction mixture was stirred an additional 5 to 10 minutes at 60° C. and then cooled to room temperature, about 25° C. The mixture was then filtered and the collected solid product was washed with water until the acidity of the used wash water was about 5.5. The product was dried for 16 hours in a vacuum oven at 120° F. to afford 4.8 grams (0.012 mole, 86 percent of theory) of a white powder. The Karl-Fischer analysis of the product after drying in a vacuum oven indicated that there was 1.44 percent water in the product. One mole of water in the product would equal 3.75 percent.

Infrared spectra of the above product indicated the presence of an aluminum carboxylate (Al—COO—) bond not present in the starting acid and a decrease of the acid peaks characteristic of the starting material 3,4diethoxybenzoic acid. There also appears a shoulder on the hydroxyl band (3,400 to 3,500 $cm^{-1}$ region) that could be attributed to an Al-OH band.

Elemental Analysis for $C_{22}H_{27}O_9Al$ Calculated: C, 57.1; H, 5.90; Al, 5.83. Found: C, 56.4; H, 5.92; Al, 4.80.

EXAMPLE III

Synthesis of Bis(3,4,5-Trimethoxybenzoato)Hydroxy Aluminum

To a solution of 17.67 grams (0.44 mole) of NaOH in 400 milliliters of water were added 62.5 grams (0.295 mole) of 3,4,5-trimethoxybenzoic acid. The resulting mixture was heated to 75° C. to dissolve the acid. A second solution was prepared by dissolving 49.07 grams (0.074 mole) of aluminum sulfate, $Al_2(SO_4)_3.18H_2O$, in 300 milliliters of water with heating to 75° C. The former solution containing the sodium salt of the acid was added rapidly and dropwise into the latter aluminum sulfate salt solution with stirring. When the addition was completed, the reaction mixture was stirred an additional 5 to 10 minutes at 75° C. and then cooled to room temperature, about 25° C. The mixture was then filtered and the collected solid product was washed with water until the acidity of the used wash water was about 5.5. The product was dried for 16 hours in a vacuum oven at 120° F. to afford 54 grams (0.116 mole, 79 percent of theory) of a white powder. The Karl-Fischer analysis of the product after drying in a vacuum oven indicated that there was 2.27 percent water in the product. One mole of water in the product would equal 3.74 percent.

Infrared spectra of the above product indicated the presence of an aluminum carboxylate (Al—COO—) bond not present in the starting acid and a decrease of the acid peaks characteristic of the starting material, 3,4,5-trimethoxybenzoic acid. There also appears a shoulder on the hydroxyl band (3,400 to 3,500 $cm^{-1}$ region) that could be attributed to an Al-OH band.

Elemental Analysis for $C_{20}H_{23}O_{11}Al$ Calculated: C, 5.15;H, 4.98;Al, 5.79. Found: C, 48.4; H, 4.78; Al, 5.94.

EXAMPLE IV

There was prepared in an extrusion device, available as ZSK-28 from Werner Pfleiderer, a toner composition comprised of 95.5 parts of styrene/butadiene copolymer and 4.5 parts of PV FAST BLUE TM pigment obtained from Hoechst Celanese. These components were melt blended in the extruder followed by micronization and air classification to yield toner sized particles of 10 microns in volume average diameter as determined by a Coulter Counter. A developer was prepared by selecting 3 parts of the toner and blending it with 100 parts of Hoeganoes Anchor Steel core with a particle diameter range of from about 75 to about 150 microns, available from Hoeganoes Company, as the carrier and roll milling for a period of about 30 minutes which resulted in a developer with a toner exhibiting a triboelectric charge of −8.2 microcoulombs per gram as determined by the known Faraday Cage method. A charge spectrograph analysis of the developer measured at 125 volts/centimeter resulted in a bimodal charge distribution through 60 seconds indicating that the developer without charge control additive admixed in greater than 1 minute. A second developer was prepared by selecting 3 parts of the above toner and blending it with 100 parts of carrier particles that were prepared as follows: Hoeganoes Anchor Steel core with a particle diameter range of from about 75 to about 150 microns, available from Hoeganoes Company, was solution coated with 1 part by weight of a coating comprising 20 parts by weight of VULCAN TM carbon black, available from Cabot Corporation, homogeneously dispersed in 80 parts by weight of polymethylmethacrylate, which coating was solution coated from toluene. Roll milling for a period of about 30 minutes resulted in a developer with a toner exhibiting a triboelectric charge of −7.0 microcoulombs per gram. A charge spectrograph analysis of the developer measured at 125 volts/centimeter resulted in a bimodal charge distribution through 60 seconds indicating that the developer without charge control additive admixed in greater than 1 minute.

EXAMPLE V

A toner was prepared as follows: 94.5 parts of styrene/butadiene copolymer, 4.5 parts of PV FAST BLUE TM pigment from Hoechst Celanese and 1 part of the hydroxy aluminum compound of Example I were melt blended in an extruder followed by micronization and air classification to yield toner sized particles of 10 microns in volume average diameter. A developer was prepared by taking 3 parts of the toner and blending it with the coated carrier of Example IV and roll milling for a period of about 30 minutes which resulted in a developer with a toner exhibiting a triboelectric charge of −11.21 microcoulombs per gram as determined by the known Faraday Cage method. A charge spectrograph analysis of the developer measured at 125 volts/centimeter resulted in a 30 to 60 second admix, evidencing an improvement in admix performance over the same toner with no charge control additive.

EXAMPLE VI

A toner was prepared as in Example V except 3 parts of the hydroxy aluminum compound of Example I and 9.25 parts of the copolymer was used. A developer was prepared by repeating the process of Example V except the bare steel carrier as in Example IV was used instead of the coated carrier. The resulting developer exhibited a triboelectric charge of −13.56 microcoulombs per gram. A charge spectrograph analysis of the developer measured at 125 volts/centimeter resulted in a 15 to 30 second admix. A developer using this toner was prepared with the coated carrier as in Example V resulting in a triboelectric charge of −16.50. A charge spectrograph analysis of the developer measured at 125 volts/centimeter resulted in a 30 to 60 second admix.

EXAMPLE VII

A toner was prepared by repeating the process of Example V except that 1 part of the hydroxy aluminum compound of Example II was selected as the charge additive. A developer using this toner was prepared with the coated carrier as in Example V resulting in a triboelectric charge of −14.92 microcoulombs per gram. A charge spectrograph analysis of the developer measured at 125 volts/centimeter resulted in a 15 second admix.

EXAMPLE VIII

A toner was prepared by repeating the process of Example V except that 1 part of the hydroxy aluminum compound prepared in Example III was used. A developer with this toner was prepared with the coated carrier as in Example V resulting in a triboelectric charge of −13.89 microcoulombs per gram. A charge spectrograph analysis of the developer measured at 125 volts/centimeter resulted in a 30 to 60 second admix.

EXAMPLE IX

The toner of Example IV was surface blended with 0.2 part of the hydroxy aluminum compound prepared in Example I by shaking for 10 minutes at 606 RPMs using a Red Devil 5410 paint shaker. A developer using this toner was prepared with the coated carrier as in Example V resulting in a triboelectric charge of −11.31 microcoulombs per gram. A charge spectrograph analysis of the developer measured at 125 volts/centimeter revealed that at 60 seconds, while the charge distribution was not bimodal, the added toner had not yet reached the identical charge distribution as the incumbent toner.

EXAMPLE X

The toner of Example IV was surface blended with 0.2 part of the hydroxy aluminum compound of Example II by shaking for 10 minutes at 606 RPMs using a Red Devil 5410 paint shaker. A developer using this toner was prepared with the coated carrier of Example V resulting in a triboelectric charge of −15.62 microcoulombs per gram. A charge spectrograph analysis of the developer measured at 125 volts/centimeter revealed that at 60 seconds, while the charge distribution was not bimodal, the added toner had not yet reached the identical charge distribution as the incumbent toner.

EXAMPLE XI

The toner from Example IV was surface blended with 0.2 part of the hydroxy aluminum compound prepared in Example III by shaking for 10 minutes at 606 RPMs using a Red Devil 5410 paint shaker. A developer using this toner was prepared with the coated carrier of Example V resulting in a triboelectric charge of −15.10 microcoulombs per gram.

EXAMPLE XII

A toner was prepared by repeating the process described in Example V except that 97 parts of a cross-linked polyester consisting of a 50/50 mixture of fumaric acid and propoxylated bisphenol A was used in place of the styrene/butadiene resin and 3 parts of the hydroxy aluminum compound known as BONTRON E-88 TM from Orient Chemicals was used in place of the aluminum compound prepared in Example I. The melt flow properties of this toner were measured using a melt index apparatus at a temperature of 117° C. with a 2.16 kiligram weight resulting in a M.I. of 3.46. The extruded resin without the aluminum compound in this Example resulted in a M.I. of 19.55 when measured under the same conditions.

EXAMPLE XIII

A toner was prepared by repeating the process described in Example XII except that 3 parts of the aluminum compound prepared in Example I were used in place of the BONTRON E-88 TM . The melt flow properties of this toner were measured using a melt index apparatus at a temperature of 117° C. with a 2.16 kiligram weight resulting in a M.I. of 18.32 which is indicative that the melt theology of the resin did not change due to the presence of the aluminum compound as it did with the BONTRON E-88 TM .

Other modifications of the present invention may occur to those skilled in the art subsequent to a review of the present application. The aforementioned modifications, including equivalents thereof, are intended to be included within the scope of the present invention.

What is claimed is:

1. A negatively charged toner composition comprised of resin, pigment, and an aluminum charge enhancing additive of the following formulas

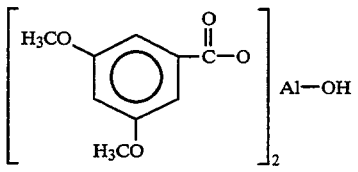

or

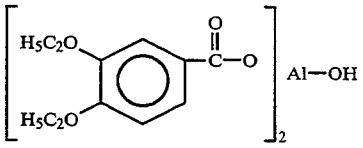

-continued or

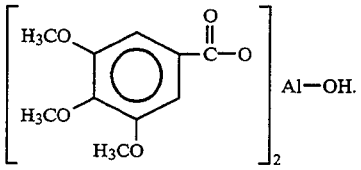

2. A toner composition in accordance with claim 1 wherein the resin is comprised of styrene polymers, acrylate polymers, methacrylate polymers, or polyesters.

3. A toner composition in accordance with claim 1 wherein the resin is comprised of styrene acrylates, styrene methacrylates, or styrene butadienes.

4. A toner composition in accordance with claim 1 containing a wax component which has a weight average molecular weight of from about 1,000 to about 7,000.

5. A toner composition in accordance with claim 4 wherein the waxy component is selected from the group consisting of polyethylene and polypropylene.

6. A toner composition in accordance with claim 1 wherein the toner further includes surface additives of metal salts of a fatty acid, colloidal silicas, titanium oxides, or mixtures thereof.

7. A toner composition in accordance with claim 1 wherein the pigment is carbon black, magnetites, or mixtures thereof, cyan, magenta, yellow, red, blue, green, brown pigments or dyes, or mixtures thereof.

8. A toner composition in accordance with claim 1 wherein the charge additive is bis(3,5-dimethoxybenzoato)hydroxy aluminum.

9. A toner composition in accordance with claim 1 wherein the charge additive is bis(3,4-diethoxybenzoato)hydroxy aluminum.

10. A toner composition in accordance with claim 1 wherein the charge additive is bis(3,4,5-trimethoxybenzoato)hydroxy aluminum.

11. A dry developer composition comprised of the toner composition of claim 1 and carrier particles.

12. A dry developer composition in accordance with claim 11 wherein the carrier particles are comprised of ferrites, steel, or an iron powder.

13. A dry developer composition in accordance with claim 11 wherein the carrier particles contain a coating of a polyvinylidene fluoride, a polymethyl methacrylate, or a mixture of polymers not in close proximity in the triboelectric series.

14. A dry developer composition in accordance with claim 11 wherein the carrier particles contain a coating of polyvinylidene fluoride and polymethylmethacrylate.

* * * * *